US008251541B2

(12) United States Patent
Lin

(10) Patent No.: US 8,251,541 B2
(45) Date of Patent: Aug. 28, 2012

(54) TUBELESS LIGHT-EMITTING DIODE BASED LIGHTING DEVICE

(75) Inventor: Chin-Lung Lin, Taipei (TW)

(73) Assignee: Unistar Opto Corporation, Taipei (TW)

( * ) Notice: Subject to any disclaimer, the term of this patent is extended or adjusted under 35 U.S.C. 154(b) by 352 days.

(21) Appl. No.: 12/731,535

(22) Filed: Mar. 25, 2010

(65) Prior Publication Data

US 2011/0156591 A1 Jun. 30, 2011

(30) Foreign Application Priority Data

Dec. 31, 2009 (TW) ..... 98224862 U

(51) Int. Cl.
*F21S 4/00* (2006.01)

(52) U.S. Cl. ..... 362/249.02; 362/249.05; 362/257; 362/294; 315/295; 315/291; 315/313; 315/315

(58) Field of Classification Search ..... 362/227, 362/249.01, 249.02, 249.05, 257, 294, 800; 315/291, 294, 295, 307, 313, 315
See application file for complete search history.

(56) References Cited

U.S. PATENT DOCUMENTS

| | | | | |
|---|---|---|---|---|
| 7,114,830 | B2 | 10/2006 | Robertson et al. | |
| 7,281,820 | B2 * | 10/2007 | Bayat et al. | 362/245 |
| 7,507,001 | B2 * | 3/2009 | Kit | 362/276 |
| 7,597,456 | B2 * | 10/2009 | Catalano et al. | 362/249.02 |
| 7,690,802 | B2 * | 4/2010 | Higley et al. | 362/20 |
| 2007/0223225 | A1 | 9/2007 | Eiich et al. | |
| 2007/0228999 | A1 | 10/2007 | Kit | |

FOREIGN PATENT DOCUMENTS

| | | |
|---|---|---|
| TW | M365434 | 9/2009 |
| TW | M368749 | 11/2009 |

* cited by examiner

*Primary Examiner* — Haiss Philogene
(74) *Attorney, Agent, or Firm* — Rosenberg, Klein & Lee

(57) ABSTRACT

A tubeless light-emitting diode (LED) based lighting device includes at least one base, at least one LED lighting module, and at least one control circuit. The base includes a heat dissipation body. The LED lighting module is mounted to the base so that the base provides the LED lighting module with the functions of retention and heat dissipation. The control circuit is mounted to the base and is electrically connected to power wiring of the LED lighting module for ON/OFF switching of the LED lighting module and supplying of operation power. As such, a tubeless lighting device that emits light in a power saving manner and is constructed in a volume reduced manner is provided.

19 Claims, 14 Drawing Sheets

100

TUBELESS LIGHT-EMITTING DIODE BASED LIGHTING DEVICE

BACKGROUND OF THE INVENTION

1. Field of the Invention

The present invention relates to a tubeless lighting device, and in particular to a light-emitting diode (LED) based lighting device that has a tubeless structure for indoor and outdoor applications for lighting and features environmental conservation, power saving, and volume reduction.

2. The Related Arts

Fluorescent lamps are well known for indoor and outdoor applications for lighting. A conventional fluorescent tube gives off light by applying electrical discharging and requires various components, including a tube mount, tube connectors, and a ballast (transformer) and a starter. This leads to the disadvantages of being heavy and bulky and requiring a large amount of ferrous material. Further, the fluorescent tube contains therein mercury, which is considered a server environmental pollutant. Thus, the fluorescent tube, once disposed of, often leads to pollution to the environment. Further, a number of contacts must be formed among the tube, the tube connectors, the ballast, and the starter and such contacts present an increase of impedance that leads to unnecessary and additional consumption of power. This is the reason that the fluorescent tube gets high power consumption and a low power factor and this is also a cause for reducing the lifespan of the tube and the ballast.

Further, the conventional fluorescent tube uses tube connectors made of plastics, which are susceptible to deterioration due to high temperature, leading to structural instability, so that when the fluorescent is subjected to external vibration or earthquakes, the tube may unexpectedly fall and hurt people standing around. Thus, the total weight of lighting devices is often subjected to a limitation in applications where vibration/quake must be constrained. This leads to a constraint for the applications of the fluorescent tubes.

Solutions for such a problem are available in the market, such as Taiwan Utility Model Nos. M368749 and M365434, US Patent Publication No. 2007/0228999, which discloses a "retrofit LED lamp for fluorescent fixtures without ballast", US Patent Publication No. 2007/0223225, which discloses a "LED lighting unit applied to a fluorescent lighting fixture" and U.S. Pat. No. 7,114,830, which discloses an "LED replacement for fluorescent lighting". All these prior art references provide an LED based lighting module that is constructed in the form of a florescent tube for replacing the fluorescent tube. Such LED based solutions, although effectively eliminating the mercury based pollutant contained in the fluorescent tubes, require components, such as LED circuit boards, heat dissipaters, wires, and shades, that are not naturally decomposable and may thus cause an increase of the garbage in replacing lighting tubes and eventually lead to secondary pollution to the environments.

Those prior art references provide LED lighting tubes that still need the components used in the fluorescent lamps, such as tube mounts, tube connectors, ballasts, and starters, as well as wiring arrangements, so that the known LED lighting tubes are still of the disadvantages of being heavy and bulky, large consumption of ferrous material, having a large number of contacts, and short lifespan. Further, the LED based lighting tubes require LED circuit boards, heat dissipaters, wiring, and shades, all such components adding an undesired increase of overall weight, making it difficult to apply to environments where vibrations/quakes must be constrained. Further, the problem associated with structural instability between the tube and the tube connectors still exists that may cause underside hurting to a user. Thus, the known LED based lighting tube still suffers a number of drawbacks that must be overcome for a more prevailing trend of LED based lighting tubes.

SUMMARY OF THE INVENTION

The state-of-the-art fluorescent tubes of LED based power-saving lighting devices require a tube, which makes the known lighting devices heavy and bulky and consuming a large amount of ferrous material and adding a large number of contact points, leading to excessive power consumption, environmental pollution, and shortened lifespan. Structural instability may occur between the known lighting tube and tube connectors, which often causes falling of the tube to hurt users and limits the applications of the lighting tubes in certain environments, where vibrations/quakes must be constrained.

In view of such problems, it is desired to provide a tubeless lighting device that reduces the manufacturing cost, the consumption of ferrous material, the number of contact points and factors that might cause pollution to the environment, and that increases the lifespan and reduce the risk of hurting the users.

Thus, a primary objective of the present invention aims to provide a tubeless light-emitting diode (LED) based lighting device, which comprises at least one base, at least one LED lighting module, and at least one control circuit. The base comprises a heat dissipation body. The LED lighting module is mounted to the base so that the base provides the LED lighting module with the functions of retention and heat dissipation. The control circuit is mounted to the base and is electrically connected to power wiring of the LED lighting module for ON/OFF switching of the LED lighting module and supplying of operation power. As such, a tubeless lighting device that emits light in a power saving manner and is constructed in a volume reduced manner is provided.

A secondary objective of the present invention is to provide a tubeless LED based lighting device, which comprises an LED lighting module made up of at least one multi-dice packaged LED chip, each of the multi-dice package LED chip emitting light that is projected in the form of a surface light source and realizes illumination as a surface light source.

A third objective of the present invention is to provide a tubeless LED based lighting device, which comprises an LED lighting module made up of at least one circuit board and a plurality of individual single-dice light-emitting diode elements each of which is electrically connected to the circuit board so that each of the single-dice light-emitting diode elements gives of light in the form of a point light source for realizing projection and illumination of light.

A fourth objective of the present invention is to provide a tubeless LED based lighting device, which comprises a base to which a shade is coupled in such a way that the shade covers outside an LED lighting module mounted to the base to provide a function of adjustment of light projection for the light emitted from the LED lighting module.

A fifth objective of the present invention is to provide a tubeless LED based lighting device, which comprises a layer of waterproof substance in an interior space and on a surface thereof to provide water protection for an LED lighting module and a control circuit.

The effectiveness of the tubeless LED based lighting device of the present invention is that a tubeless lighting device is composed of a base, an LED lighting module, a control circuit, and a shade, which greatly reduces the overall weight and size of a lighting device and also reduces the amount of ferrous material used and the number of contact points in the circuit thereof, so as to reduce power consumption, eliminate potential risk of environmental pollution, and extend the lifespan of the lighting device. Further, the risk of falling tube hurting users can be avoided to ensure operation safety and make the tubeless LED based lighting device applicable to various environments.

BRIEF DESCRIPTION OF THE DRAWINGS

The present invention will be apparent to those skilled in the art by reading the following description of preferred embodiments thereof, with reference to the attached drawings, wherein.

DETAILED DESCRIPTION OF THE PREFERRED EMBODIMENTS

Figure 1:
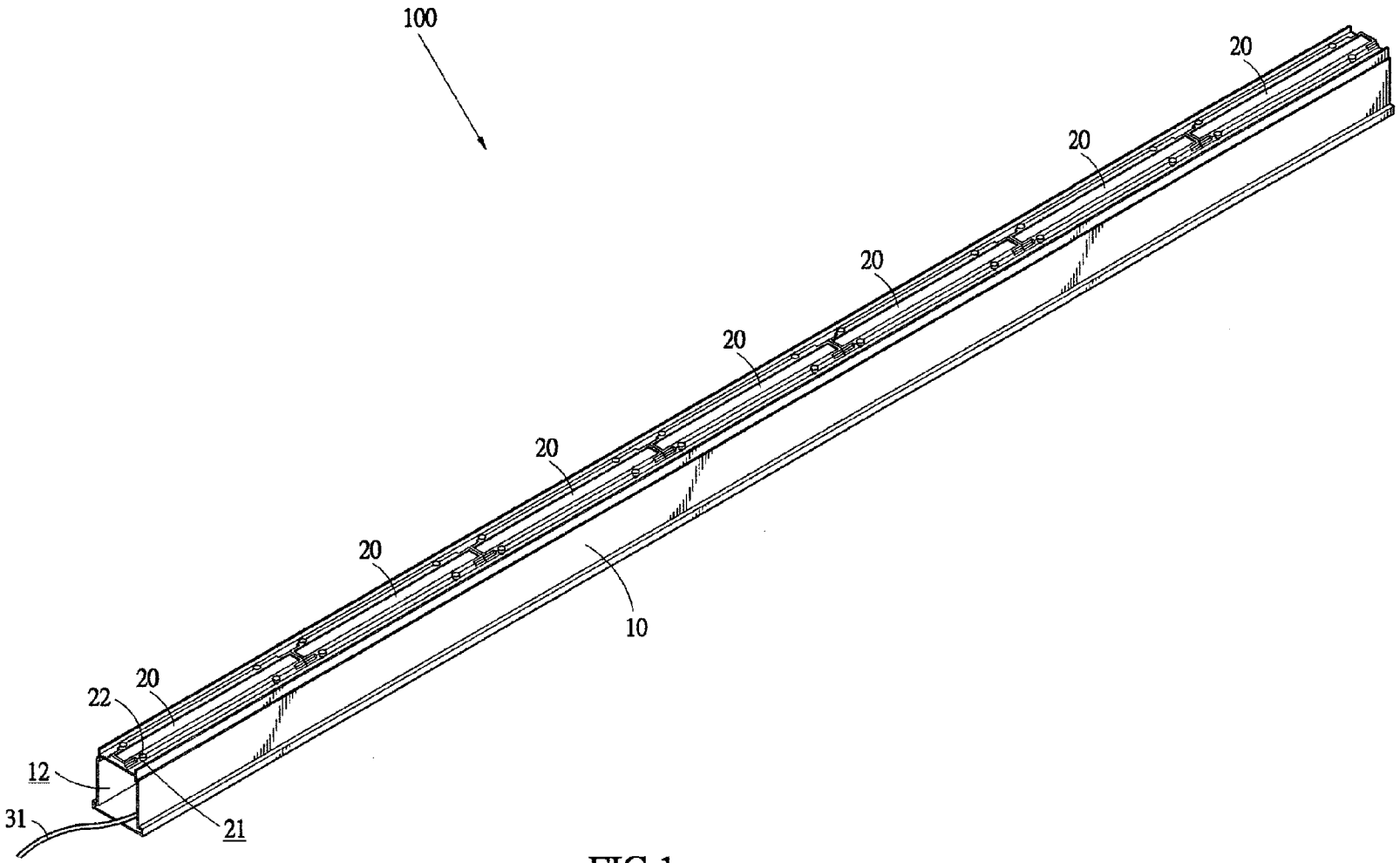
FIG. 1 is a perspective view showing a tubeless light-emitting diode (LED) based lighting device constructed in accordance with a first embodiment of the present invention.
Figure 2:
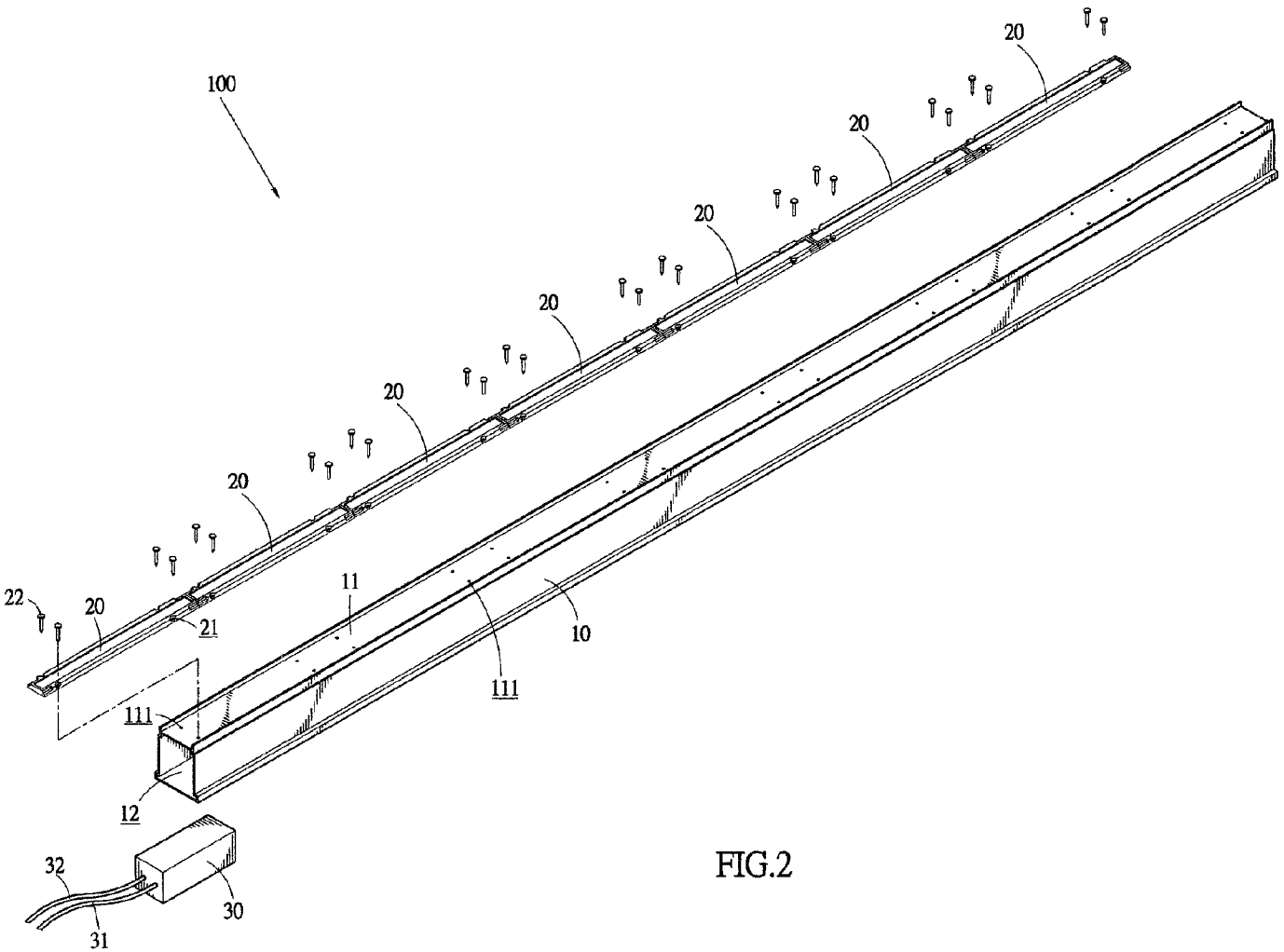
FIG. 2 is an exploded view of the tubeless LED based lighting device of the first embodiment of the present invention shown in FIG. 1.

With reference to the drawings and in particular to FIGS. 1 and 2, a tubeless light-emitting diode (LED) based lighting device constructed in accordance with a first embodiment of the present invention, generally designated at 100, is shown. The tubeless LED based lighting device 100 of the present invention comprises at least one base 10, which is made up of a heat dissipative body. The base 10 is not limited to any specific shape, and in the first embodiment of the present invention, comprises a hollow aluminum extrusion, which is taken as an illustrative but not limitative example. The base 10 has a top forming at least one connection section 11. The connection section 11 defines a plurality of inner-threaded holes 111. The base 10 has a hollow interior space forming at least one receiving channel 12.

At least one LED lighting module 20 is provided and a single multi-dice packaged LED chip is taken as an example for the LED lighting module 20 in the first embodiment. The LED lighting module 20 has a surface forming a plurality of through holes 21 respectively corresponding to the inner-threaded holes 111 of the base 10 and respectively receiving threaded fasteners 22, such as screws or bolts, for connecting and fixing the LED lighting module 20 to the connection section 11 of the base 10, whereby the base 10, as a whole, serves heat dissipation for the LED lighting module 20.

At least one control circuit 30 is provided, having the functions of controlling ON/OFF switching of the LED(s) and conversion between alternate current (AC) and direct current (DC). The control circuit 30 is received and retained in the receiving channel 12 of the base 10. The control circuit 30 comprises least one power cable 31 and a control cable 32. The power cable 31 extends out of the receiving channel 12 of the base 10 to selectively connect to an external power source, such as an electric main. The control cable 32 is electrically connected to the LED lighting module 20, so that the LED lighting module 20 is controlled by the control circuit 30 for ON/OFF switching operation. Further, the control circuit 30 supplies a direct current for the operation of the LED lighting module 20 so that the LED lighting module 20 may persistently provide a surface light source.

The connection between the LED lighting module 20 and the base 10 is not limited to threaded coupling by threaded fasteners 22 extending through and engaging the inner-threaded holes 111 of the base 10. The retention of the control circuit 30 to the base 10 is also not limited to receiving the control circuit 30 in the receiving channel 12 of the base 10. Also, the arrangement of the power cable 31 of the control circuit 30 extending out of the base 10 is not limited to extending through the receiving channel 12, and various equivalent arrangements and means can be taken to realize the same results without departing from the scope of the present invention.

Figure 3:
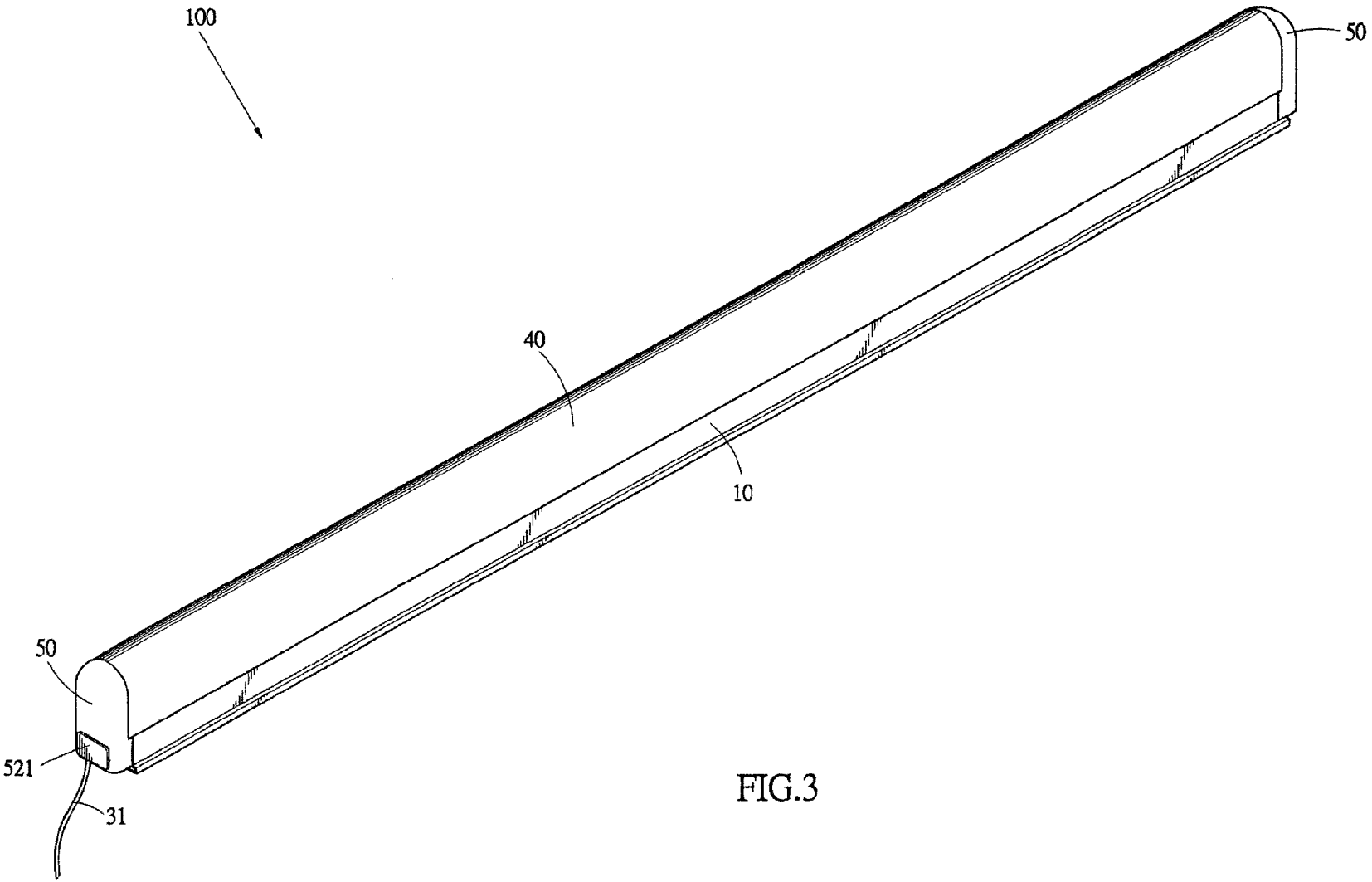
FIG. 3 is a perspective view showing a tubeless LED based lighting device constructed in accordance with a second embodiment of the present invention.
Figure 4:
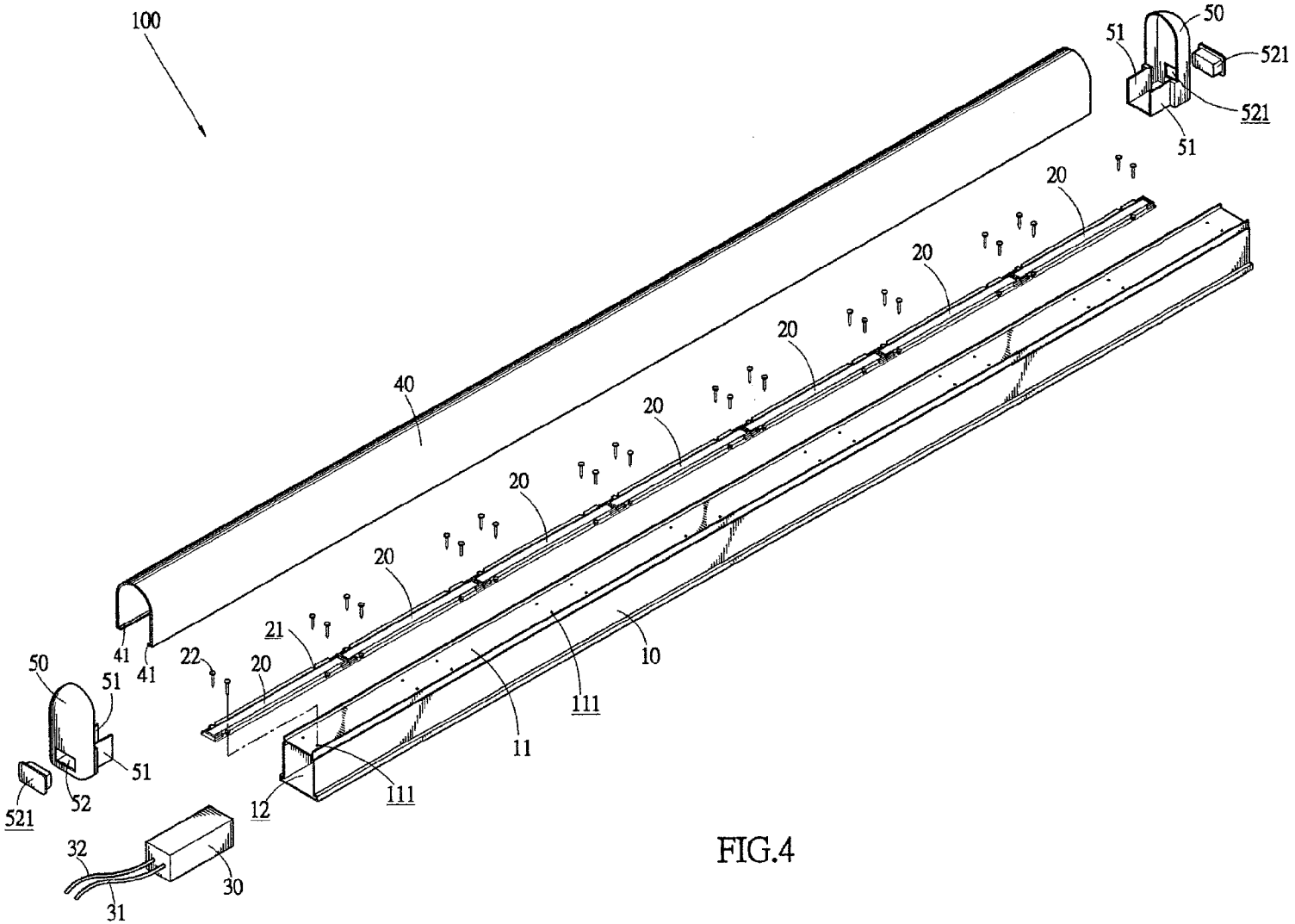
FIG. 4 is an exploded view of the tubeless LED based lighting device of the second embodiment of the present invention shown in FIG. 3.

Referring to FIGS. 3 and 4, a tubeless LED based lighting device constructed in accordance with a second embodiment of the present invention is shown, and is also designated with reference numeral 100. At least one shade 40 is coupled to the base 10. The shade 40 has inside edges forming at least one fitting rim 41 for fitting to and thus attaching to the top of the base 10 and covering outside the LED lighting module 20. The shade 40 also provides the function of adjustment of light projection for the surface light source of the LED lighting module 20. A pair of end caps 50 is attached to and seals opposite open ends between the shade 40 and the base 10. Each of the end caps 50 has a lower portion forming a plurality of connection tabs 51 and defines an opening 52. The connection tabs 51 are fit into the receiving channel 12 of the base 10, and one of end caps 50 allows the power cable 31 of the control circuit 30 to extend outward through the opening 52 thereof. The opening 52 of the end caps 50 is closed by a sealing plug 521.

Figure 5:
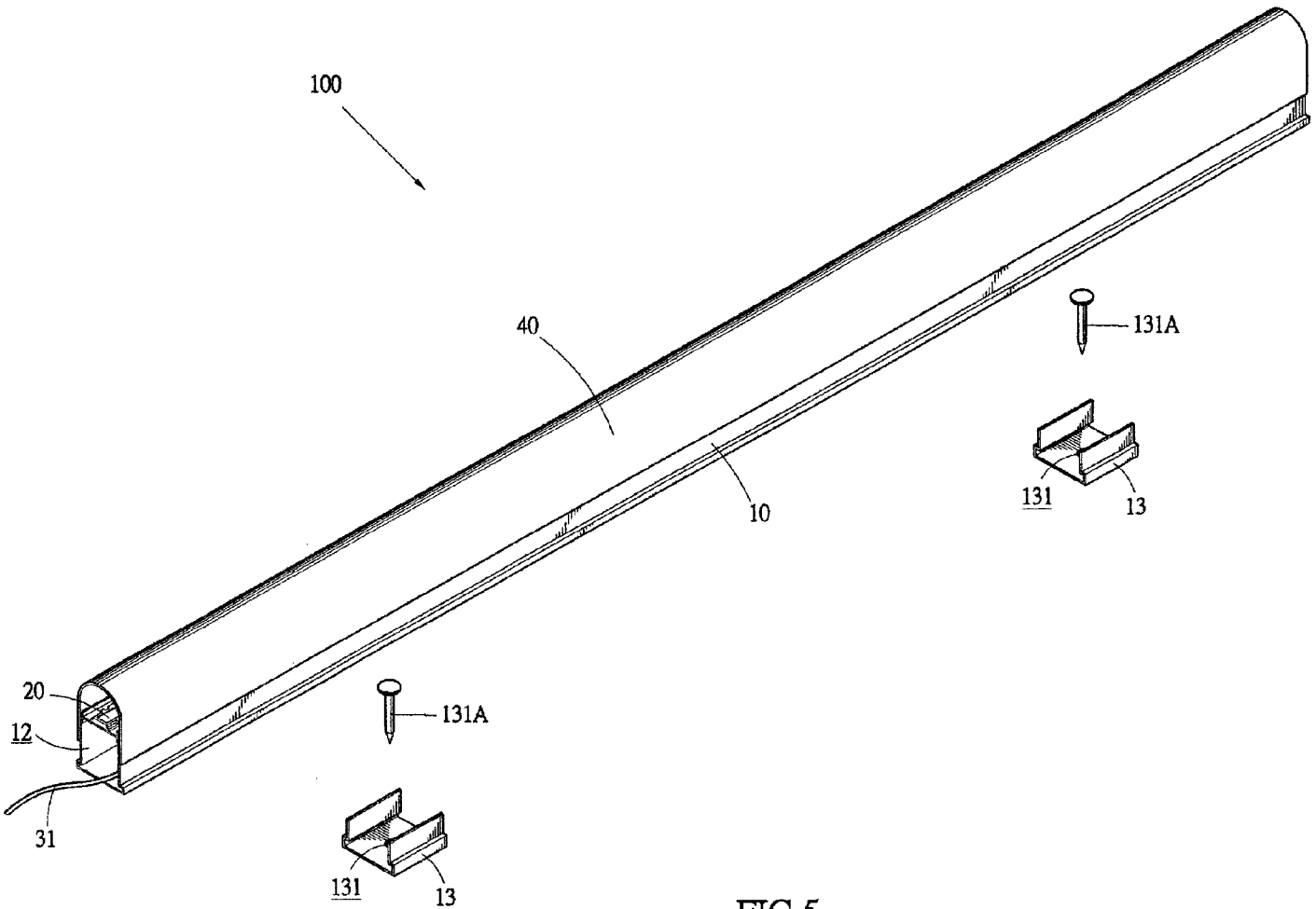
FIG. 5 is a perspective view showing a tubeless LED based lighting device constructed in accordance with a third embodiment of the present invention.
Figure 6:
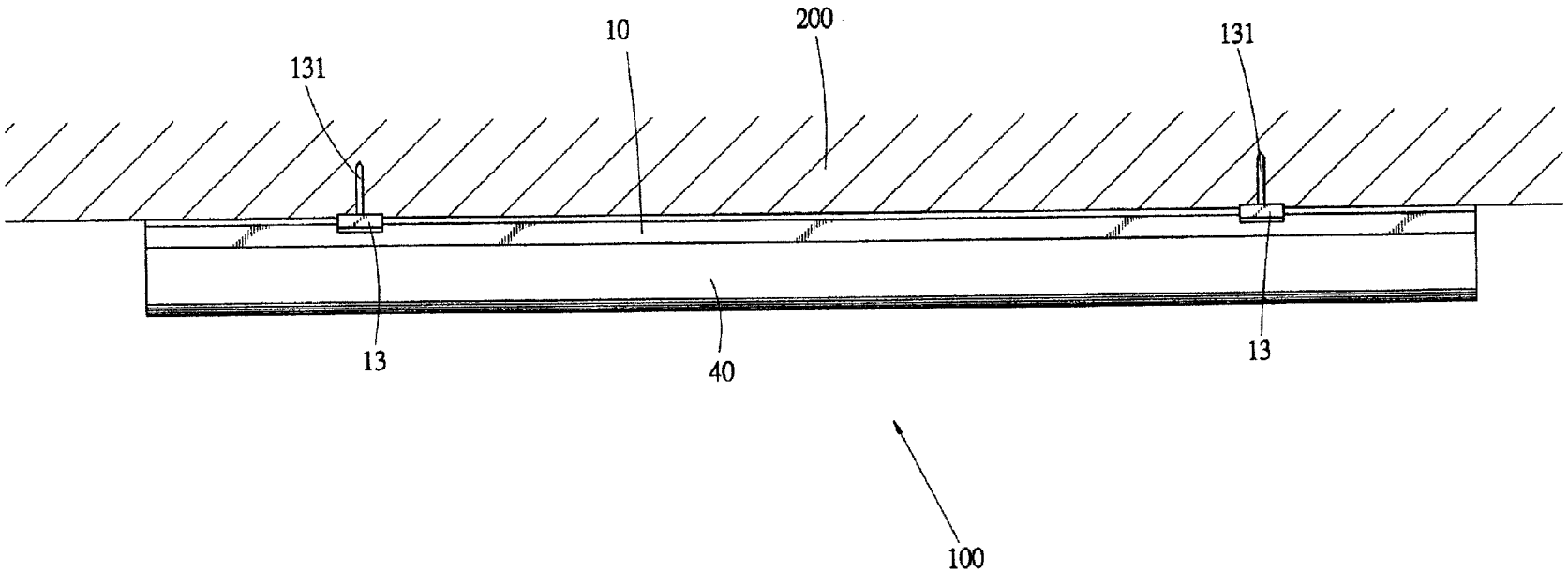
FIG. 6 is an exploded view of the tubeless LED based lighting device of the third embodiment of the present invention shown in FIG. 5.

Referring to FIGS. 5 and 6, a tubeless LED based lighting device constructed in accordance with a third embodiment of the present invention is shown and is also designated with reference numeral 100. At least one mounting element 13 is fit over and clamps a bottom of the base 10. The mounting element 13 forms at least one hole 131 that receives a fastener 131A to extend therethrough for mounting to a fixture, such as ceiling, whereby the base 10 is attached to the ceiling 200 to allow tubeless LED based lighting device 100 of the present invention to be applicable to ceiling lighting mounted to the ceiling 200.

The mounting of tubeless LED based lighting device 100 shown in FIGS. 5 and 6 to the ceiling 200 is not limited to use of a mounting element 13 that is fit over and clamps the base 10, and any other equivalent arrangements and structures are considered within the scope of the present invention.

Figure 7:
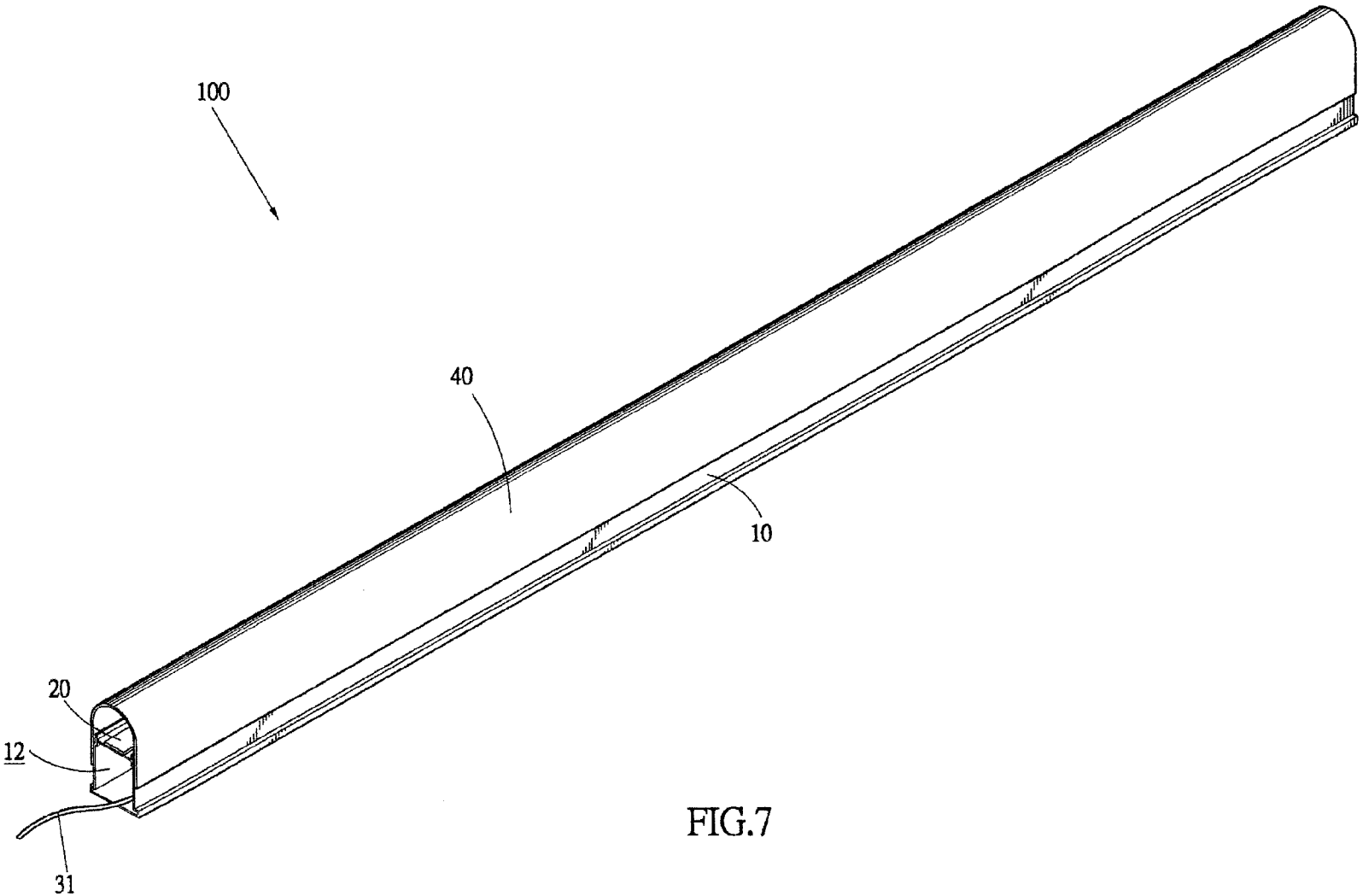
FIG. 7 is a perspective view showing a tubeless LED based lighting device constructed in accordance with a fourth embodiment of the present invention.
Figure 8:
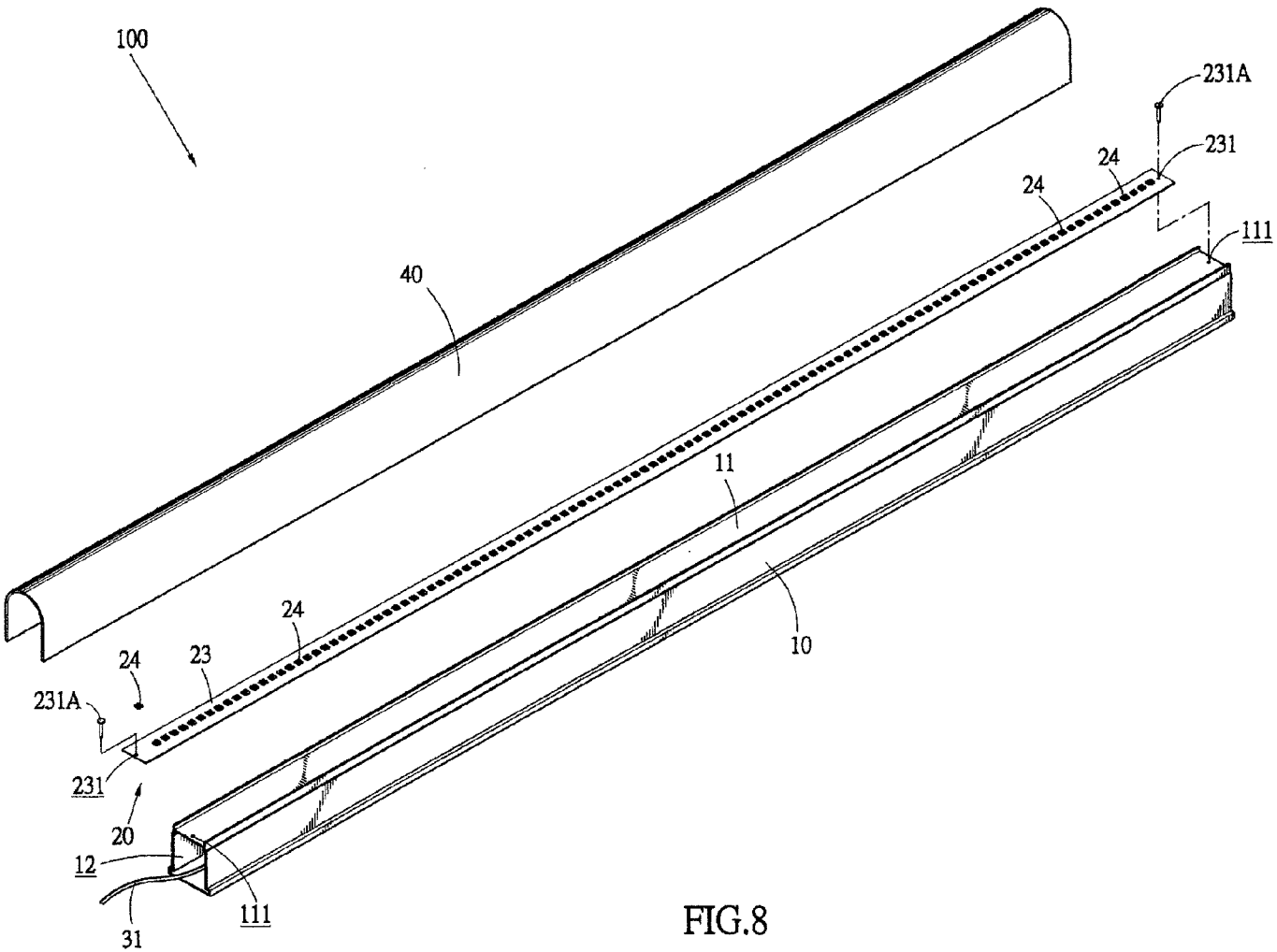
FIG. 8 is an exploded view of the tubeless LED based lighting device of the fourth embodiment of the present invention shown in FIG. 7.

Referring to FIGS. 7 and 8, a tubeless LED based lighting device constructed in accordance with a fourth embodiment of the present invention is shown and is also designated with reference numeral 100. In the instant embodiment, the LED lighting module 20 comprises a lighting module made up of a plurality of individual point light sources. The LED lighting module 20 comprises at least one circuit board 23 and a plurality of individual single-dice LED's 24. The circuit board 23 forms a plurality of mounting holes 231 respectively set in alignment with the inner-threaded holes 111 of the connection section 11 of the base 10 to respectively receive threaded fasteners 231A for mounting to the connection section 11 of the base 10. The circuit board 23 has a surface forming power connection wiring arrangement thereon for the LED's. Each LED 24 is electrically connected to the circuit board 23, so that the power connection wiring arrangement of each LED 24 is connected to the circuit board 23 to allow the LED 24 to receive supply of operation power for emission of a point light source, whereby the LED lighting module 20, as a whole, gives off lights from a plurality of point light sources.

Figure 9:
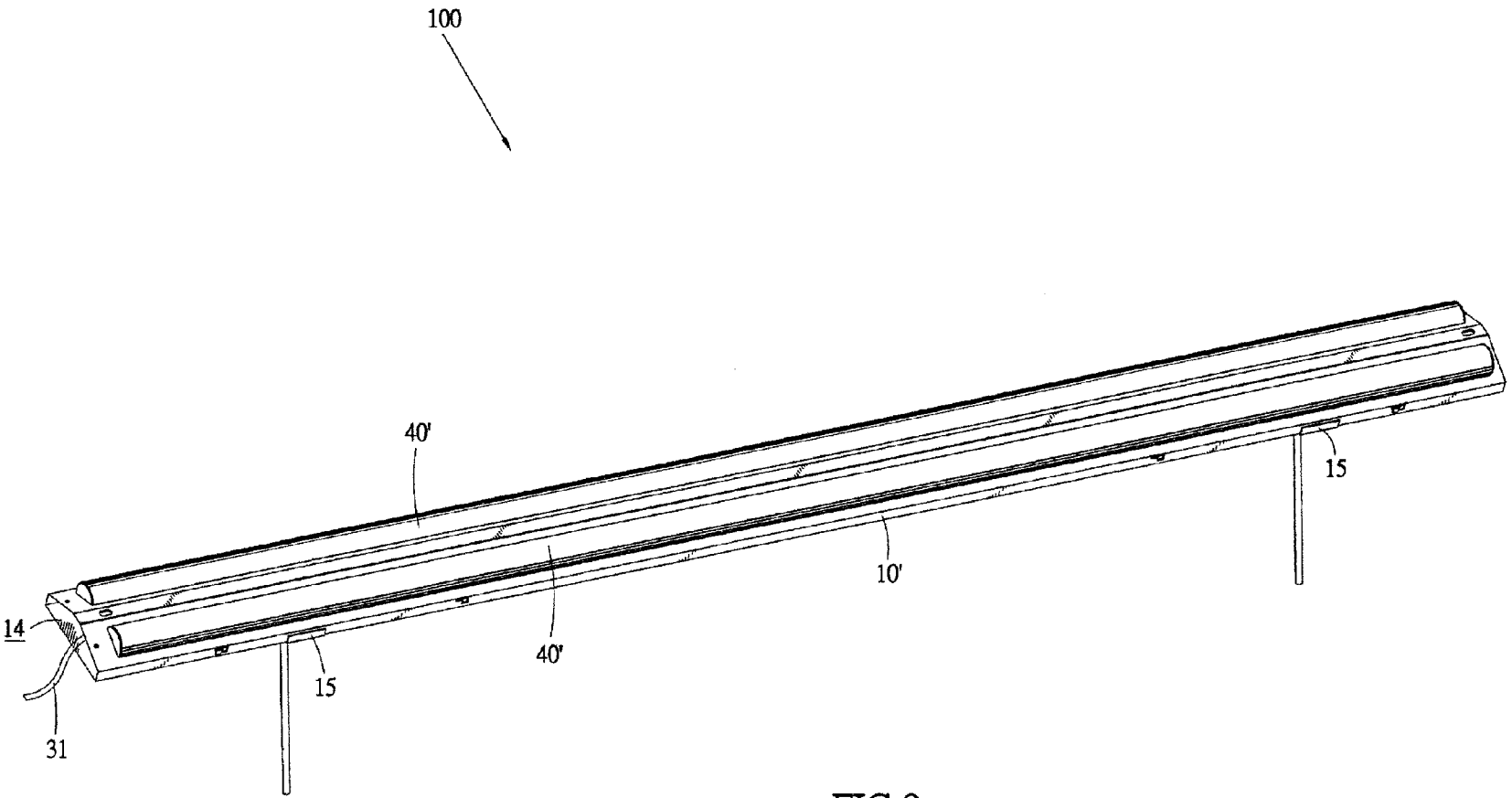
FIG. 9 is a perspective view showing a tubeless LED based lighting device constructed in accordance with a fifth embodiment of the present invention.
Figure 10:
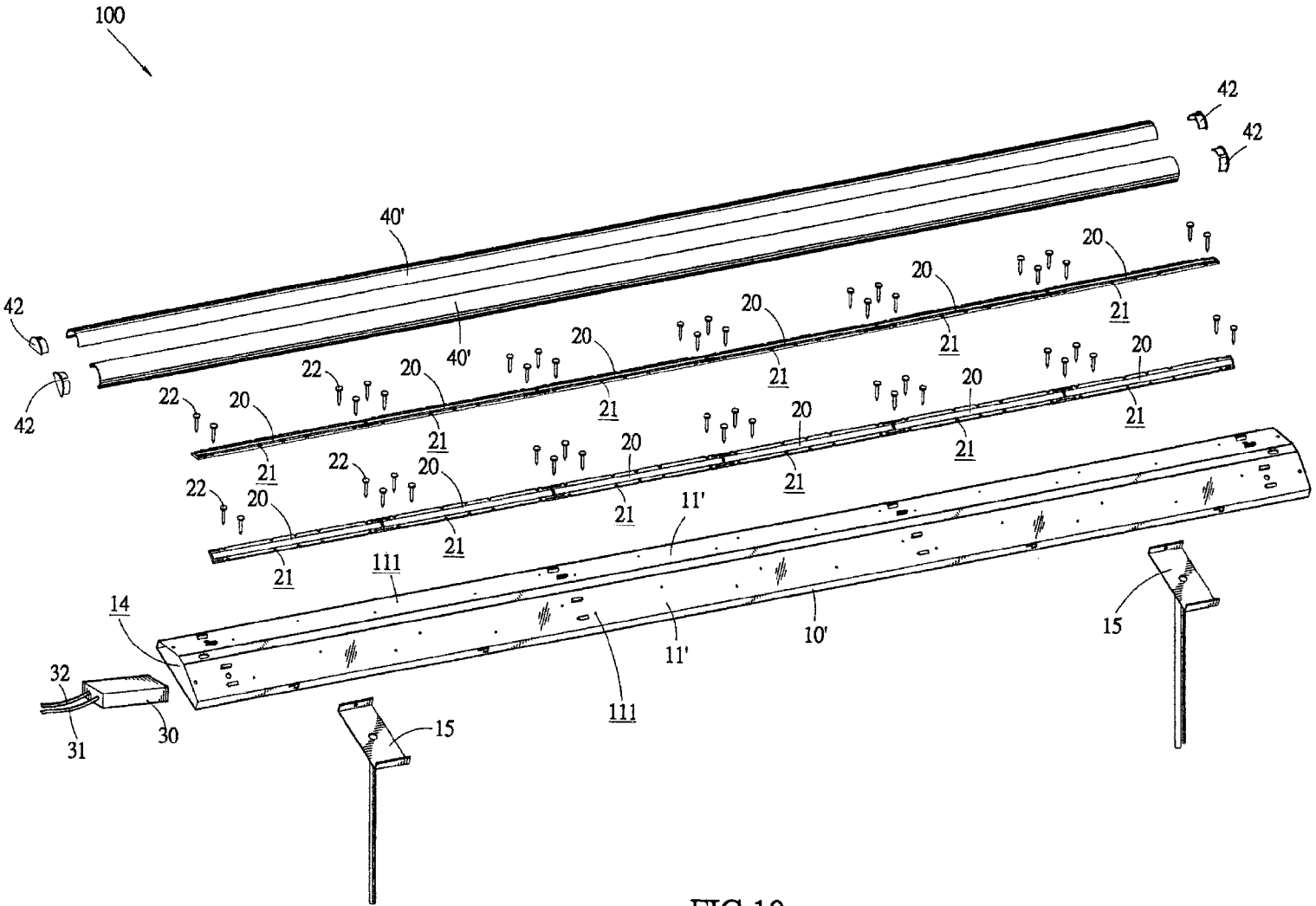
FIG. 10 is an exploded view of the tubeless LED based lighting device of the fifth embodiment of the present invention shown in FIG. 9.

Referring to FIGS. 9 and 10, a tubeless LED based lighting device constructed in accordance with a fifth embodiment of the present invention is shown and is also designated with reference numeral 100. In the instant embodiment, mimicking is made for a dual-tube triangularly-structured fluorescent lamp, and thus the base 10' is constructed to present a triangular cross-section, which provides, on a top side thereof, two connection sections 11', each forming an inclined surface. Each connection section 11' receives an LED lighting module 20 to mount thereon. The LED lighting modules 20 can be a surface-light-source lighting device made up of a single multi-dice packaged LED chip shown in the embodiment illustrated in FIGS. 1-6, or alternatively comprise a multiple-point-light-source lighting module made up of a circuit board 23 and a plurality of single-dice LED's 24 as shown in the embodiment of FIGS. 7 and 8. In the embodiment illustrated in FIGS. 9 and 10, a single multi-dice packaged LED chip is taken as an example for the lighting module, wherein the two LED lighting modules 20 both provide a surface light source that may realize an extended coverage of projection area.

In the embodiment illustrated in FIGS. 9 and 10, the base 10' has a lower portion forming a receiving chamber 14, and the control circuit 30 is received and retained in the receiving chamber 14. The lower portion of the base 10' is coupled to at least one pair of suspension arms 15, which suspends the base 10' under a ceiling 200, whereby the tubeless LED based lighting device 100 can be suspended under the ceiling for lighting or other purposes. In the embodiment illustrated in FIGS. 9 and 10, the shade 40' is closed at opposite ends by closure caps 42.

Figure 11:
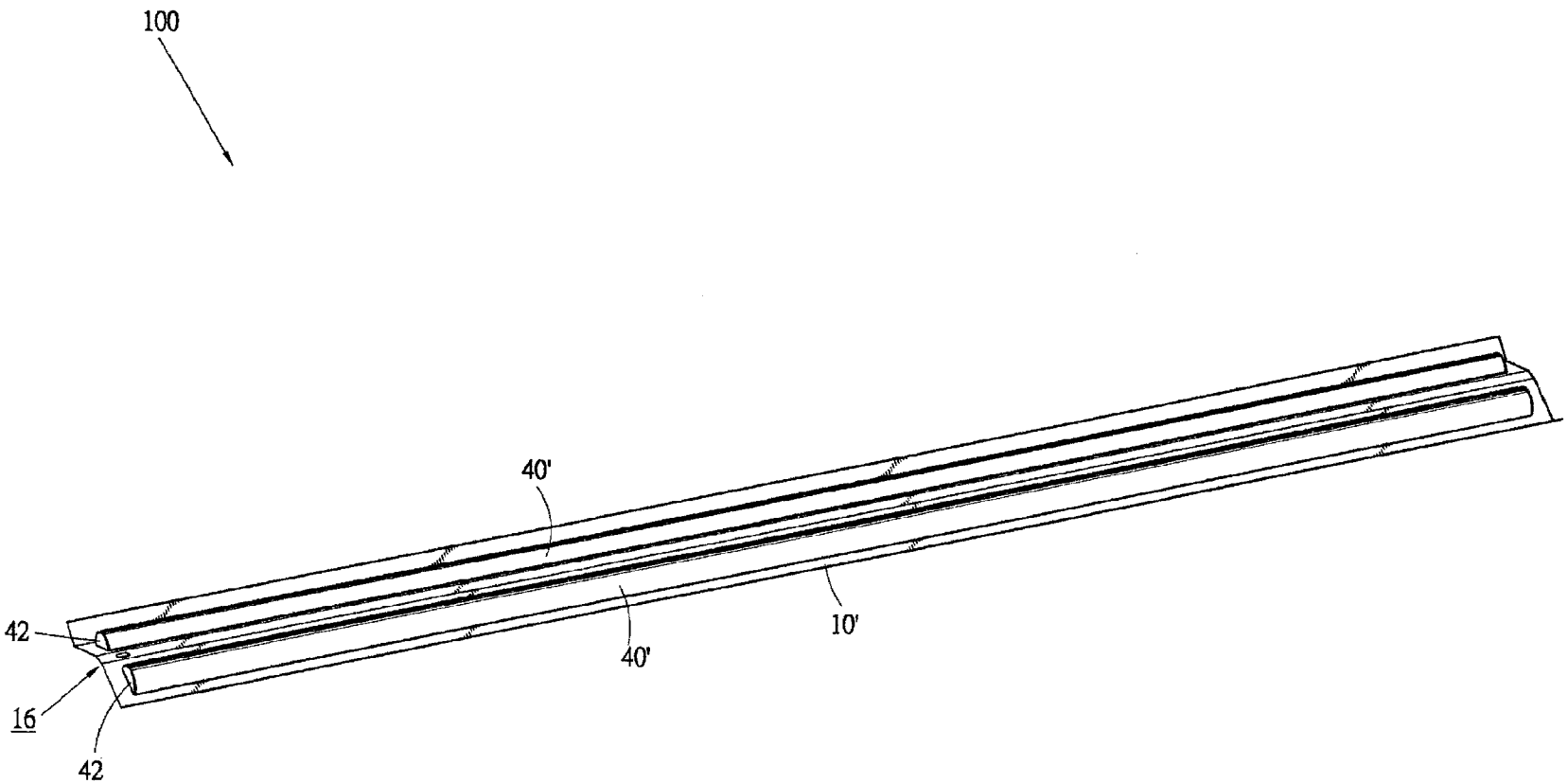
FIG. 11 is a perspective view showing a tubeless LED based lighting device constructed in accordance with a sixth embodiment of the present invention.
Figure 12:
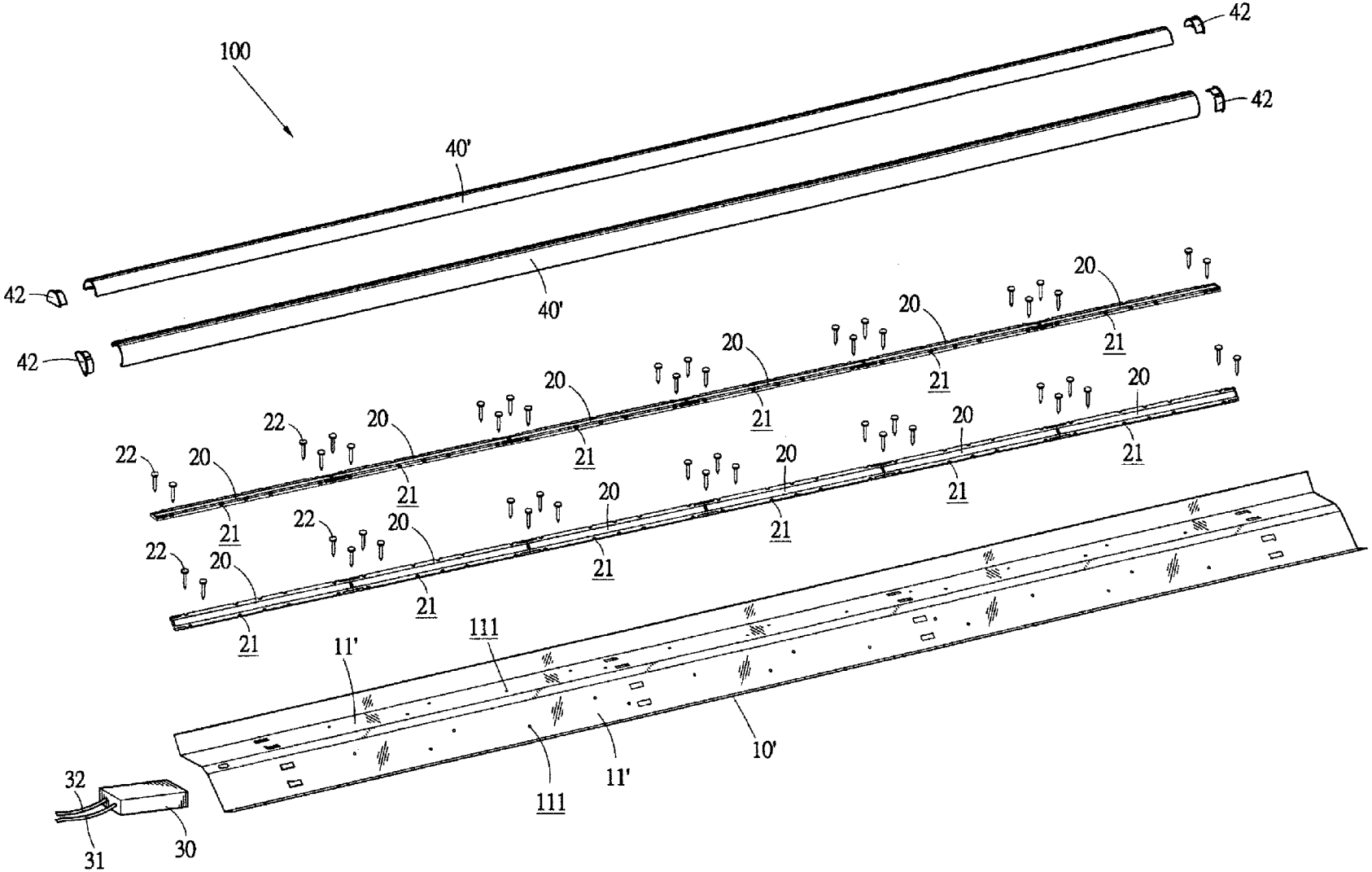
FIG. 12 is an exploded view of the tubeless LED based lighting device of the sixth embodiment of the present invention shown in FIG. 11.

Referring to FIGS. 11 and 12, a tubeless LED based lighting device constructed in accordance with a sixth embodiment of the present invention is shown and is also designated with reference numeral 100. In the instant embodiment, mimicking is made for a dual-tube chevron-structured fluorescent lamp, wherein the base 10' is constructed to present a chevron cross-section, which provides, on a top side thereof, two connection sections 11', each forming a recessed inclination. Each connection section 11' receives an LED lighting module 20 mounted thereon. The LED lighting modules 20 can be a surface-light-source lighting device made up of a single multi-dice packaged LED chip shown in the embodiment illustrated in FIGS. 1-6, or alternatively comprise a multiple-point-light-source lighting module made up of a circuit board 23 and a plurality of single-dice LED's 24 as shown in the embodiment of FIGS. 7 and 8. In the embodiment illustrated in FIGS. 11 and 12, a single multi-dice packaged LED chip is taken as an example for the lighting module, wherein the two LED lighting modules 20 both provide a surface light source that may realize an extended coverage of projection area.

In the embodiment illustrated in FIGS. 11 and 12, the base 10' has a bottom forming a recess 16, and the control circuit 30 is received and retained in the recess 16.

Figure 13:
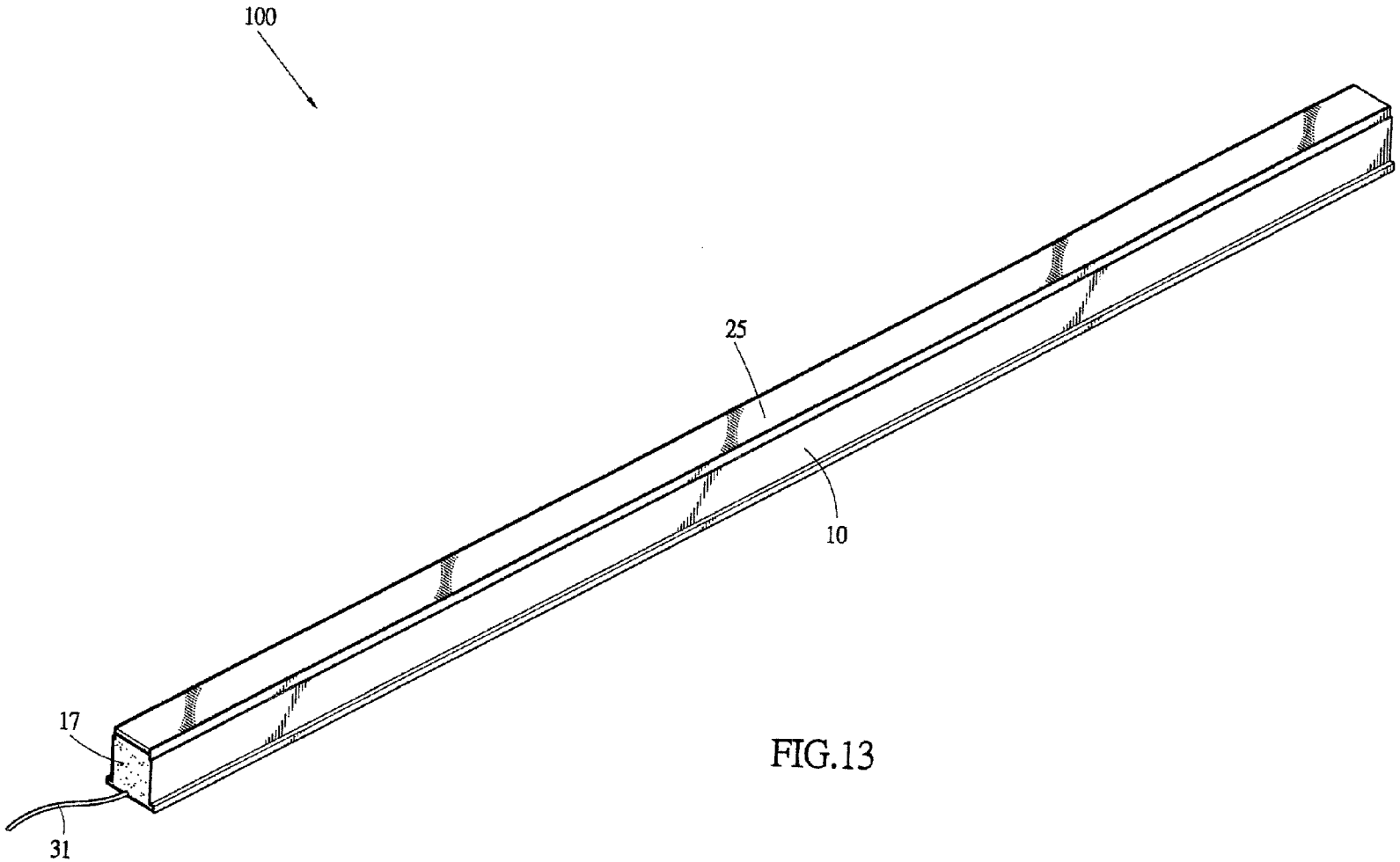
FIG. 13 is a perspective view showing a tubeless LED based lighting device constructed in accordance with a seventh embodiment of the present invention.
Figure 14:
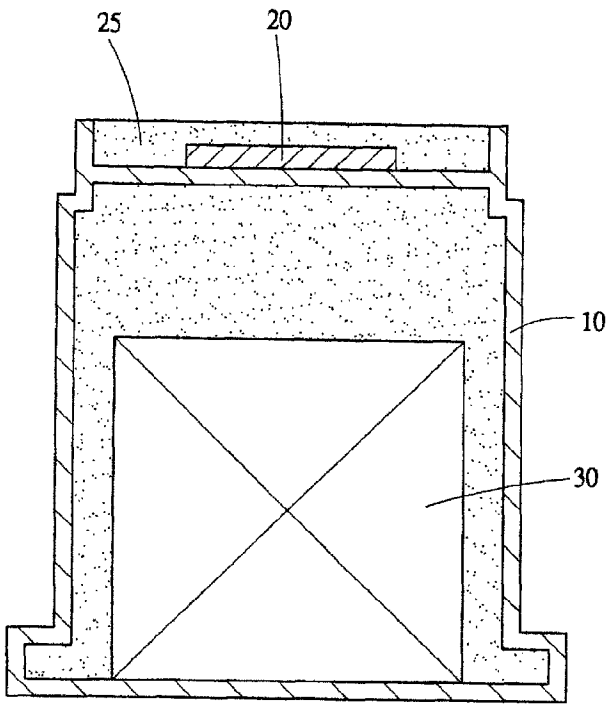
FIG. 14 is an enlarged end view showing a receiving channel, an LED lighting module, and waterproof resin of the tubeless LED based lighting device of the seventh embodiment of the present invention shown in FIG. 13.

Referring to FIGS. 13 and 14, a tubeless LED based lighting device constructed in accordance with a seventh embodiment of the present invention is shown and is also designated with reference numeral 100. In the instant embodiment, the base 10 comprises at least one layer of waterproof resin 17 or substance of the same functions arranged inside the receiving channel 12 thereof, and further, at least one layer of waterproof resin 25 or substance of the same functions is applied to a surface of the LED lighting module 20 of the connection section 11 of the base 10 to provide protection against water invasion to the LED lighting module 20 and the control circuit 30, whereby the tubeless LED based lighting device 100 of the present invention can be of expanded application in a humid environment. The arrangement of the waterproof resin 17 inside the receiving channel 12, or the arrangement of the waterproof resin 25 on the LED lighting module 20 is not limited to pouring and/or coating, and the waterproof substance can also be additionally applied to the fifth, sixth, and seventh embodiments shown in FIGS. 7-12.

A comparison was made between the tubeless LED based lighting device 100 of the present invention and the conventional T8 and T5 fluorescent tubes and the result is given as follows:

| | model | | |
|---|---|---|---|
| Item | conventional T8 (single tube, 2' long) | conventional T5 (single tube, 2' long) | present invention, 2' long LED lighting module of single multi-dice packaged LED chip |
| weight | 400 grams | 300 grams | 200 grams |
| illuminance (at distance of 1,200 mm) | 84 lux | 90 lux | 93 lux |
| volume and breakdown rate | large volume and short lifespan | large volume and lifespan greater than T8 | LED lighting module having the greatest lifespan and extremely low breakdown rate, overall volume being less than T5 and T8 by 50% |
| mercury contained | 15 mg | 5 mg | 0 mg |

-continued

| Item | model | | |
|---|---|---|---|
| | conventional T8 (single tube, 2' long) | conventional T5 (single tube, 2' long) | present invention, 2' long LED lighting module of single multi-dice packaged LED chip |
| lifespan of light source | 3000 hours | 10,000 hours | 100,000 hours |
| power consumption (under identical illuminance) | 27 W | 14.34 W | 10.35 W |
| annular power consumption utility expense | 464.28 kW · h NT$2,015 | 125.6 kW · h NT$545.2 | 90.67 kW · h NT$393.5 |
| ferrous material consumed | 100% | 100% | 50% |
| operation safety | tube connector may get deteriorated leading to tube falling | tube connector may get deteriorated leading to tube falling | no tube connector and no risk of falling |

According to the data listed in the above table, the tubeless LED based lighting device 100 of the present invention show superior in all respects listed to the conventional T8 and T5 fluorescent tubes. It is apparent that the present invention possesses the advantage of reducing the weight of lighting device, reducing the volume of lighting device, reducing the amount of ferrous material consumed, reducing the number of contact points of wiring arrangement and power consumption, eliminating pollution to the environment, extending the lifespan of lighting device, and ensuring operation safety of lighting device.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A light-emitting diode (LED) based lighting device, comprises:

at least one base, which has a top forming at least one connection section;

at least one LED lighting module, which is mounted to the connection section of the base; and at least one control circuit, which provides functions of selectively switching ON/OFF the LED lighting module and converting between an alternate current and a direct current, the control circuit being coupled to the base and in electrical connection with the LED lighting module and being adapted to connect to an external power source, whereby the LED lighting module is controlled by the control circuit for selectively switching ON/OFF and receives an operation power supplied from the control circuit for emission of light.

2. The LED based lighting device as claimed in claim 1, wherein the base comprises a heat dissipation body.

3. The LED based lighting device as claimed in claim 1, wherein the base has a hollow interior forming a receiving channel.

4. The LED based lighting device as claimed in claim 3, wherein the receiving channel receives at least one layer of a waterproof substance therein.

5. The LED based lighting device as claimed in claim 3, wherein the receiving channel has opposite ends to which end caps are respectively mounted.

6. The LED based lighting device as claimed in claim 5, wherein each of the end caps has a lower portion forming connection tabs that are fit into the receiving channel.

7. The LED based lighting device as claimed in claim 5, wherein the end caps define an opening.

8. The LED based lighting device as claimed in claim 7, wherein the opening is closed by a sealing plug.

9. The LED based lighting device as claimed in claim 2, wherein the base has a bottom which at least one mounting element is coupled.

10. The LED based lighting device as claimed in claim 2, wherein the base has a lower portion to which at least one suspension arm is coupled.

11. The LED based lighting device as claimed in claim 1, wherein the connection section of the base forms an inclined surface.

12. The LED based lighting device as claimed in claim 1, wherein the base has a triangular cross-section.

13. The LED based lighting device as claimed in claim 1, wherein the base has a chevron cross-section.

14. The LED based lighting device as claimed in claim 1, wherein the base comprises at least one shade attached to the top of the base.

15. The LED based lighting device as claimed in claim 14, wherein the shade has inside edges forming at least one fitting rim that is fit to the top of the base.

16. The LED based lighting device as claimed in claim 1, wherein the LED lighting module comprises at least one layer of a waterproof substance coated on a surface thereof.

17. The LED based lighting device as claimed in claim 1, wherein the LED lighting module comprises a single multi-dice packaged LED chip.

18. The LED based lighting device as claimed in claim 1, wherein the LED lighting module comprises:

at least one circuit board, which is mounted to the connection section of the base, the circuit board having a surface forming an LED power connection wiring arrangement; and a plurality of individual single-dice LED's, each of which is mounted to the circuit board to be connected with the LED power connection wiring arrangement for being powered to emit light.

19. The LED based lighting device as claimed in claim 1, wherein the control circuit comprises at least one power cable and a control cable, the power cable being adapted to connect to the external power source, the control cable being electrically connected to the LED lighting module.

* * * * *